US007083423B1

(12) United States Patent
Guerra, Jr. et al.

(10) Patent No.: US 7,083,423 B1
(45) Date of Patent: Aug. 1, 2006

(54) METHOD AND APPARATUS FOR MOUNTING A CARD CONNECTOR

(75) Inventors: William M. Guerra, Jr., Hutto, TX (US); John Stuewe, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 11/096,027

(22) Filed: Mar. 31, 2005

(51) Int. Cl.
*H01R 12/00* (2006.01)

(52) U.S. Cl. ..... 439/62; 439/61; 439/637

(58) Field of Classification Search ..... 439/59–62, 439/630–637, 325–328, 377
See application file for complete search history.

(56) References Cited

U.S. PATENT DOCUMENTS 5,961,352 A * 10/1999 Denny et al. ..... 439/637
6,152,742 A * 11/2000 Cohen et al. ..... 439/60
6,655,976 B1 * 12/2003 Shipe et al. ..... 439/328
6,824,407 B1 * 11/2004 Zhao et al. ..... 439/157

* cited by examiner

*Primary Examiner*—Ross Gushi
(74) *Attorney, Agent, or Firm*—Haynes and Boone, LLP

(57) ABSTRACT

A card connector mounting apparatus includes a base including a card coupler and having a plurality of electrical coupling members positioned on a bottom surface of the base, a first base side positioned along the length of the base, and a first board mounting member extending from the first base side and positioned adjacent the bottom surface. A board may be provided which includes a board surface having a connector coupling section defined by a plurality of electrical connector couplers positioned on the board surface, a first section side positioned along the length of the connector coupling section, and a plurality of spaced apart first connector mounting members positioned adjacent the first section side and outside the connector coupling section. A plurality of different sized card connectors may then be mounted to the board by coupling their first board mounting members to the first connector mounting member.

7 Claims, 14 Drawing Sheets

METHOD AND APPARATUS FOR MOUNTING A CARD CONNECTOR

BACKGROUND

The present disclosure relates generally to information handling systems, and more particularly to a method and apparatus for mounting a card connector in an information handling system.

As the value and use of information continues to increase, individuals and businesses seek additional ways to process and store information. One option is an information handling system. An information handling system generally processes, compiles, stores, and/or communicates information or data for business, personal, or other purposes. Because technology and information handling needs and requirements may vary between different applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Card connectors are used in information handling systems for allowing the coupling of cards to the information handling system. The card connectors are typically mounted and electrically coupled to a connector coupling section on a circuit board in the information handling system to allow cards to be electrically coupled to components in the information handling system. The mounting of these card connectors raises a number of issues.

Conventional card connectors typically include a pair of mounting pegs which are spaced apart and extend from a centrally located position on the bottom surface of the card connector. For example, typical ×16 PCI-Express connectors and ×8 PCI-Express connectors each include a pair of mounting pegs which are centrally located on the connectors such that the ×8 PCI-Express connector cannot be exchanged with a ×16 PCI-Express connector on the connector coupling section of the board because one of the ×8 PCI-Express connector mounting pegs will be positioned in the middle of the ×16 PCI-Express connector section signal field. Locating the mounting pegs in this manner does not permit the co-location of different sized card connectors or flexible design, which increases costs.

Accordingly, it would be desirable to provide a method and apparatus for mounting a card connector absent the disadvantages found in the prior methods discussed above.

SUMMARY

According to one embodiment, a card connector mounting apparatus is provided that includes a base including a card coupler and having a plurality of electrical coupling members positioned on a bottom surface of the base, a first base side positioned along the length of the base, and a first board mounting member extending from the first base side and positioned adjacent the bottom surface.

A principal advantage of this embodiment is that a plurality of different sized card connectors may be mounted to the same connector coupling section on the board, allowing flexible designs and increasing efficiency.

DETAILED DESCRIPTION

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a PDA, a consumer electronic device, a network server or storage device, a switch router or other network communication device, or any other suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communications between the various hardware components.

Figure 1:
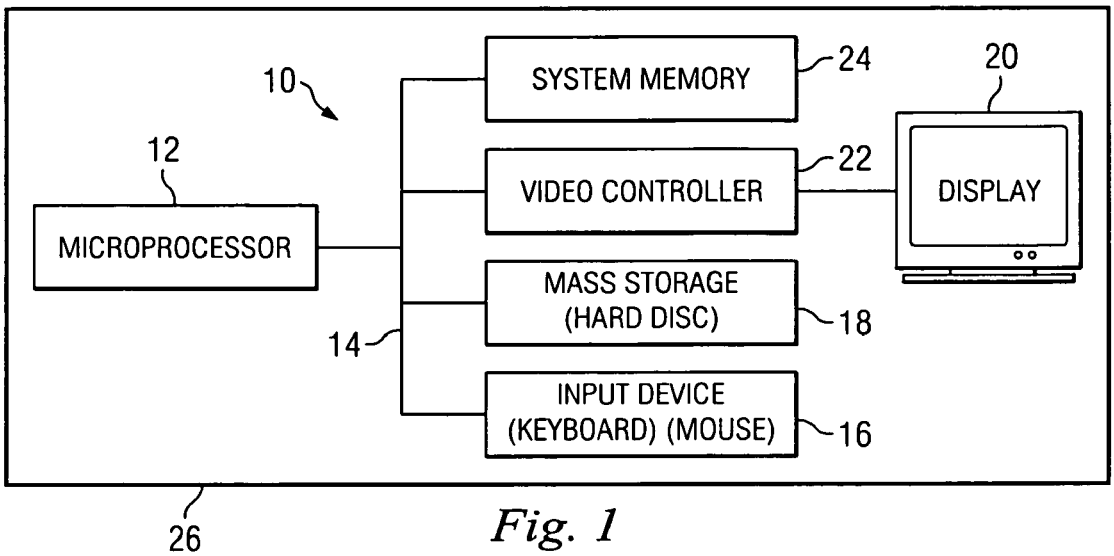
FIG. 1 is a schematic view illustrating an embodiment of an information handling system.

In one embodiment, information handling system 10, FIG. 1, includes a microprocessor 12, which is connected to a bus 14. Bus 14 serves as a connection between microprocessor 12 and other components of computer system 10. An input device 16 is coupled to microprocessor 12 to provide input to microprocessor 12. Examples of input devices include keyboards, touchscreens, and pointing devices such as mouses, trackballs and trackpads. Programs and data are stored on a mass storage device 18, which is coupled to microprocessor 12. Mass storage devices include such devices as hard disks, optical disks, magneto-optical drives, floppy drives and the like. Computer system 10 further includes a display 20, which is coupled to microprocessor 12 by a video controller 22. A system memory 24 is coupled to microprocessor 12 to provide the microprocessor with fast storage to facilitate execution of computer programs by microprocessor 12. In an embodiment, a chassis 26 may house some or all of the components of information handling system 10. It should be understood that other busses and intermediate circuits can be deployed between the components described above and microprocessor 12 to facilitate interconnection between the components and the microprocessor.

Figure 2A:
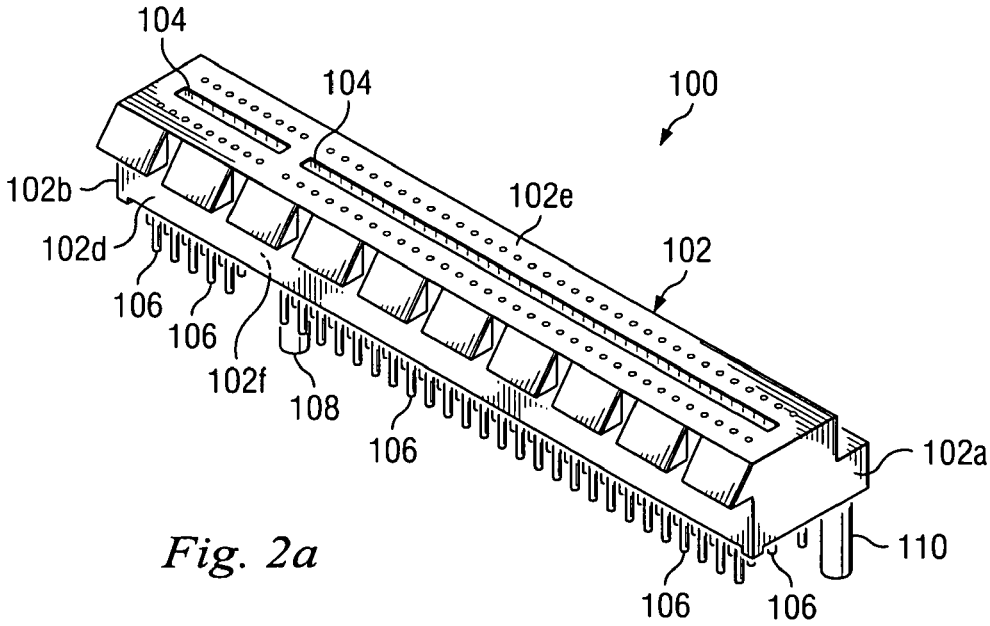
FIG. 2*a* is a perspective view illustrating an embodiment of a large card connector.
Figure 2B:
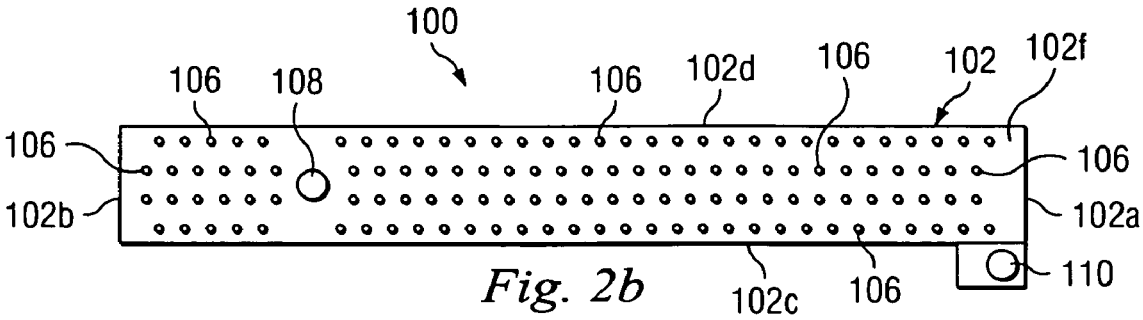
FIG. 2*b* is a bottom view illustrating an embodiment of the large card connector of FIG. 2*a*.

Referring now to FIGS. 2*a* and 2*b*, a large card connector 100 is illustrated. Large card connector 100 includes a base 102 having a first base end 102*a*, a second base end 102*b* positioned opposite the first base end 102*a*, a first base side 102*c* located along the length of the base 102, a second base side 102*d* located along the length of the base 102 and positioned opposite the first base side 102*c*, a top base surface 102*e*, and a bottom base surface 102*f* positioned opposite the top base surface 102*e* and bounded by the first base end 102*a*, the second base end 102*b*, the first base side 102*c*, and the second base side 102*d*. The base 102 defines a card coupler slot 104 on the top base surface 102*e* and along the length of the base 102. A plurality of electrical coupling members 106 extend from the bottom base surface 102*f* and along the length of the base 102. A board mounting member 108 extends from the bottom base surface 102*f*, is positioned between the first base side 102*c* and the second base side 102*d*, and is located between the electrical coupling members 106 and adjacent the second base end 102*b*. A board mounting member 110 extends from the first base side 102*c* away from the base 102 and then down past the bottom base surface 102*f*, and is positioned adjacent the bottom base surface 102*f* and the first base end 102*a*. In an exemplary embodiment, the card connector 100 includes a ×64 PCI-Express connector. In an exemplary embodiment, the card connector 100 includes a ×32 PCI-Express connector. In an exemplary embodiment, the card connector 100 includes a ×16 PCI-Express connector. In an exemplary embodiment, the card connector 100 includes a ×8 PCI-Express connector. In an exemplary embodiment, the card connector 100 includes a ×4 PCI-Express connector. In an exemplary embodiment, the card connector 100 includes a ×1 PCI-Express connector.

Figure 3A:
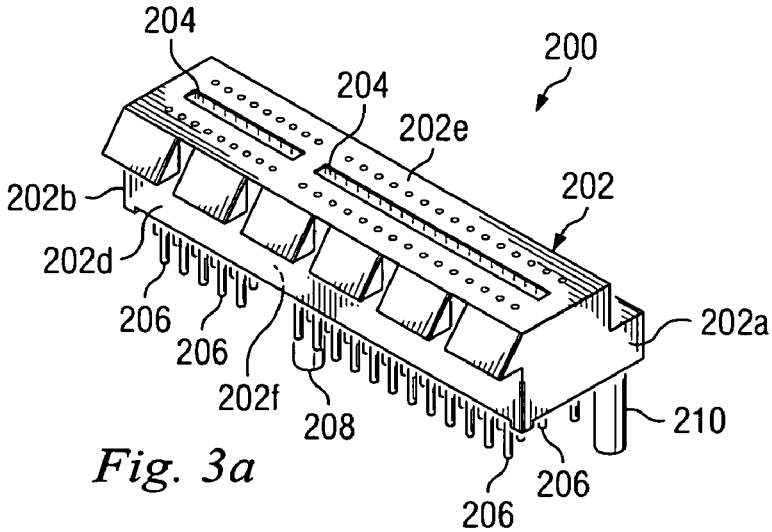
FIG. 3*a* is a perspective view illustrating an embodiment of a small card connector.
Figure 3B:
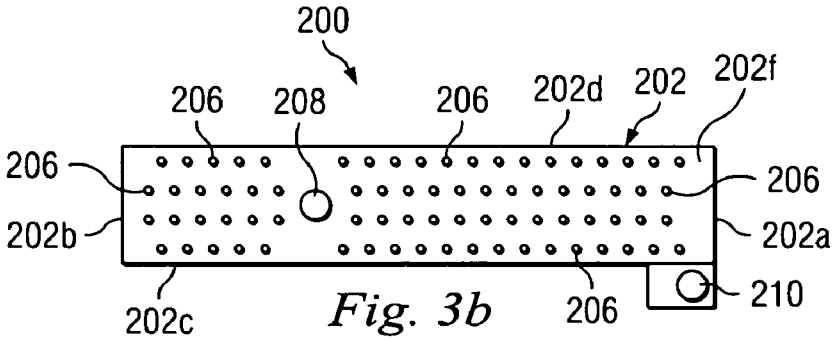
FIG. 3*b* is a bottom view illustrating an embodiment of the small card connector of FIG. 3*a*.

Referring now to FIGS. 3*a* and 3*b*, a small card connector 200 is illustrated. Small card connector 200 includes a base 202 having a first base end 202*a*, a second base end 202*b* positioned opposite the first base end 202*a*, a first base side 202*c* located along the length of the base 202, a second base side 202*d* located along the length of the base 202 and positioned opposite the first base side 202*c*, a top base surface 202*e*, and a bottom base surface 202*f* positioned opposite the top base surface 202*e* and bounded by the first base end 202*a*, the second base end 202*b*, the first base side 202*c*, and the second base side 202*d*. The base 202 defines a card coupler slot 204 on the top base surface 202*e* and along the length of the base 202. A plurality of electrical coupling members 206 extend from the bottom base surface 202*f* and along the length of the base 202. A board mounting member 208 extends from the bottom base surface 202*f*, is positioned between the first base side 202*c* and the second base side 202*d*, and is located between the electrical coupling members 206 and adjacent the second base end 202*b*. A board mounting member 210 extends from the first base side 202*c* away from the base 202 and then down past the bottom base surface 202*f*, and is positioned adjacent the bottom base surface 202*f* and the first base end 202*a*. In an exemplary embodiment, the card connector 200 includes a ×64 PCI-Express connector. In an exemplary embodiment, the card connector 200 includes a ×32 PCI-Express connector. In an exemplary embodiment, the card connector 200 includes a ×16 PCI-Express connector. In an exemplary embodiment, the card connector 200 includes a ×8 PCI-Express connector. In an exemplary embodiment, the card connector 200 includes a ×4 PCI-Express connector. In an exemplary embodiment, the card connector 200 includes a ×1 PCI-Express connector.

Figure 4:
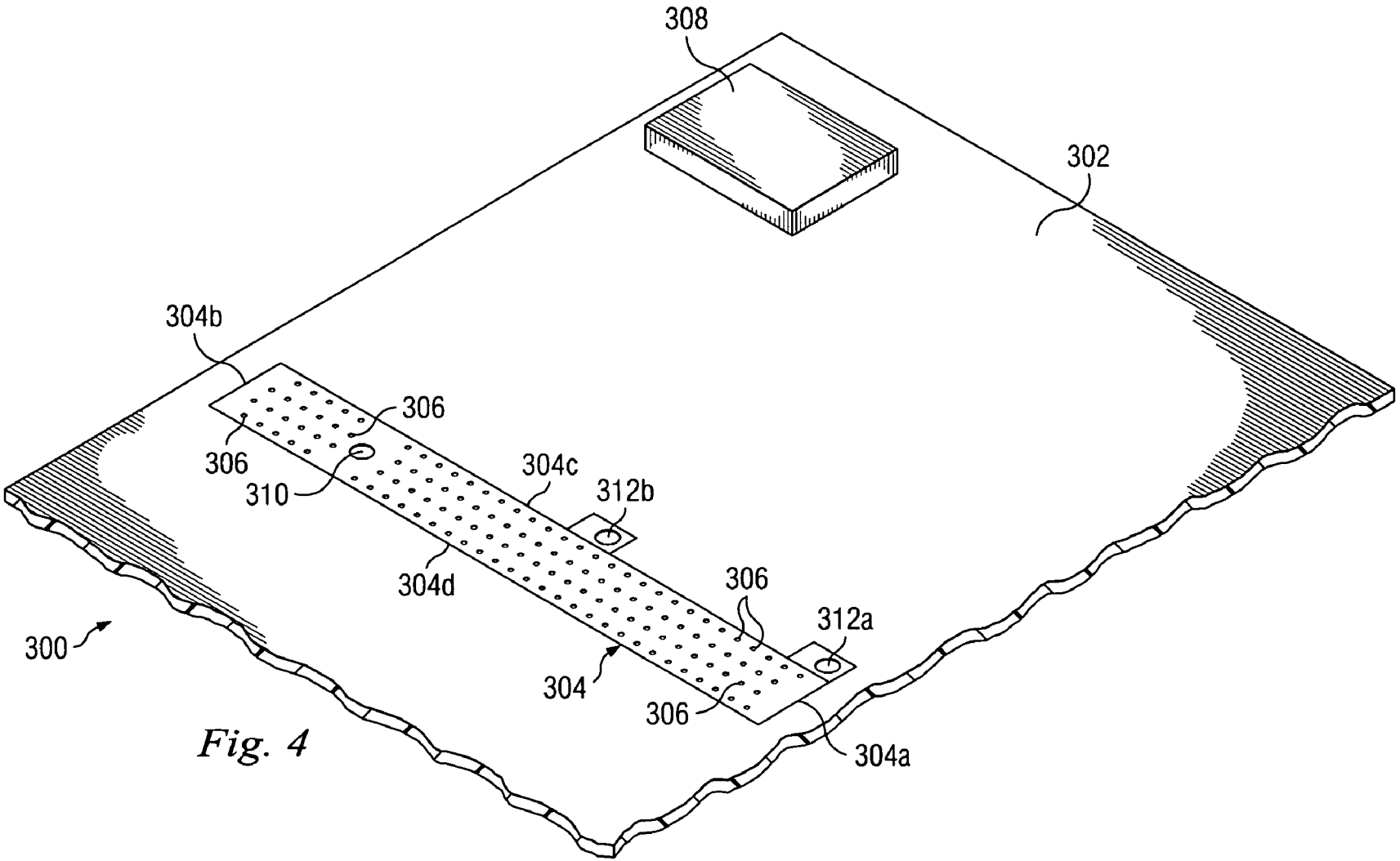
FIG. 4 is a perspective view illustrating an embodiment of a board used with the large card connector of FIG. 2*a* and the small card connector of FIG. 3*a*.

Referring now to FIG. 4, a board 300 is illustrated. Board 300 includes a board surface 302 including a connector coupling section 304. Connector coupling section 304 includes a first section end 304*a*, a second section end 304*b* positioned opposite the first section end 304*a*, a first section side 304*c* located along the length of the connector coupling section 304, and a second section side 304*d* located along the length of the connector coupling section 304 and positioned opposite the first section side 304*c*. A plurality of electrical connector couplers 306 define the connector coupling section 304 and are bounded by the first section end 304*a*, the second section end 304*b*, the first section side 304*c*, and the second section side 304*d*. In an embodiment, the electrical connector couplers 306 are electrically coupled to an information handling system component 308 which is mounted to the board surface 302. In an embodiment, the information handling system component 308 includes a chip set coupled to a microprocessor which may be, for example, the microprocessor 12 of information handling system 10, described above with reference to FIG. 1. A connector mounting member 310 is defined by the board 300, located on the board surface 302 in the connector coupling section 304, and positioned between the first section side 304*c* and the second section side 304*d*, between the plurality of electrical connector couplers 306, and adjacent the second section end 304*b*. A plurality of connector coupling members 312*a* and 312*b* are defined by the board 300, located on the board surface 302 and outside the connector coupling section 304, and positioned in a spaced apart relationship adjacent the first section side 304*c*. In an embodiment, connector coupling member 312*a* is positioned adjacent the first section end 304*a* and connector coupling member 312*b* is positioned substantially midway between the first section end 304*a* and the second section end 304*b*. In an embodiment, the board 300 may be mounted in the chassis 26, described above with reference to FIG. 1, and may include one of more of the components of information handling system 10.

Figures 5A, 5B:
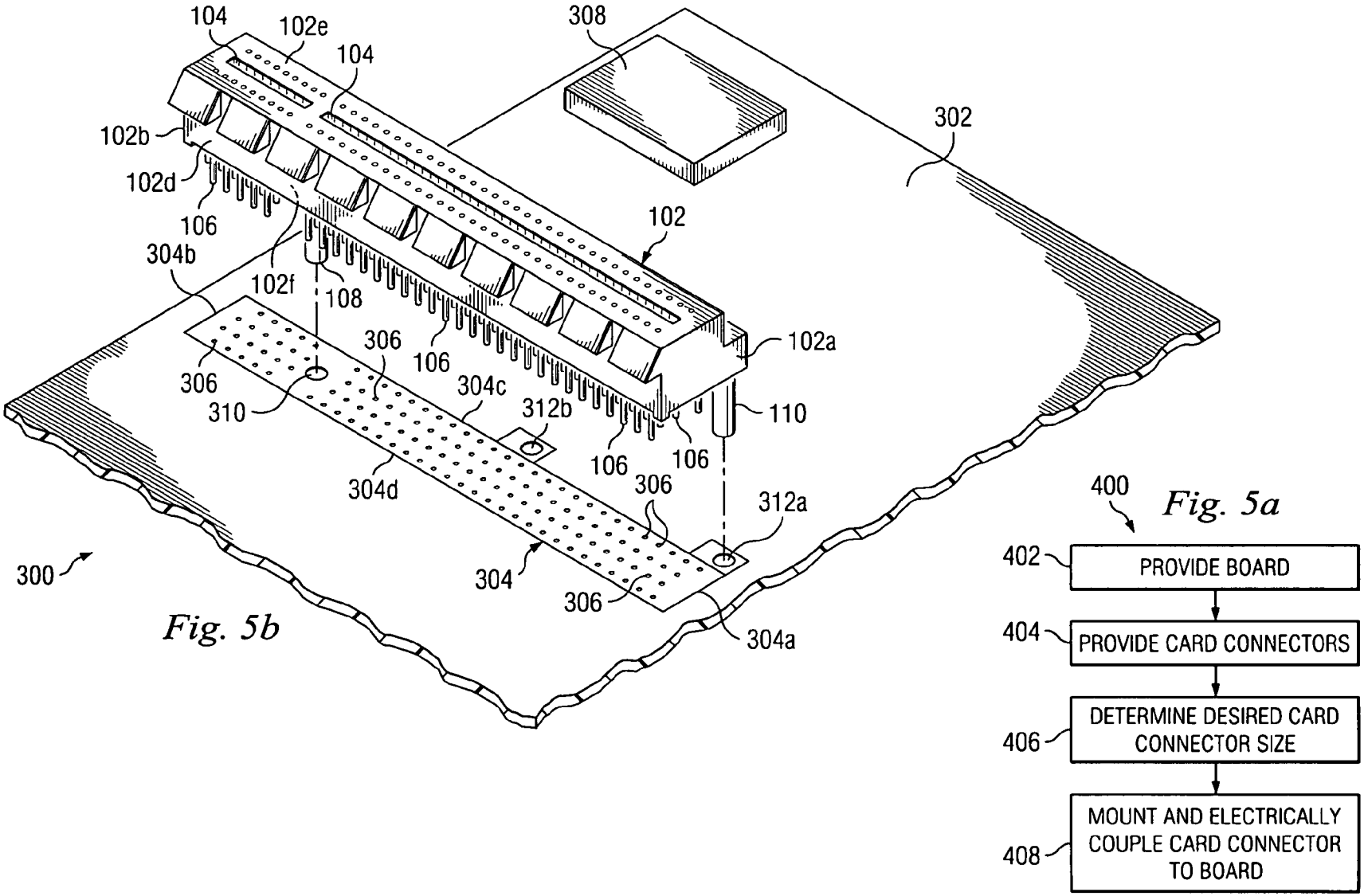
FIG. 5*a* is a flow chart illustrating an embodiment of a method for mounting a card connector using the large card connector of FIG. 2*a*, the small card connector for FIG. 3*a*, and the board of FIG. 4.
FIG. 5*b* is a perspective view illustrating an embodiment of the large card connector of FIG. 2*a* being mounted to the board of FIG. 4 during the method of FIG. 5*a*.
Figure 5C:
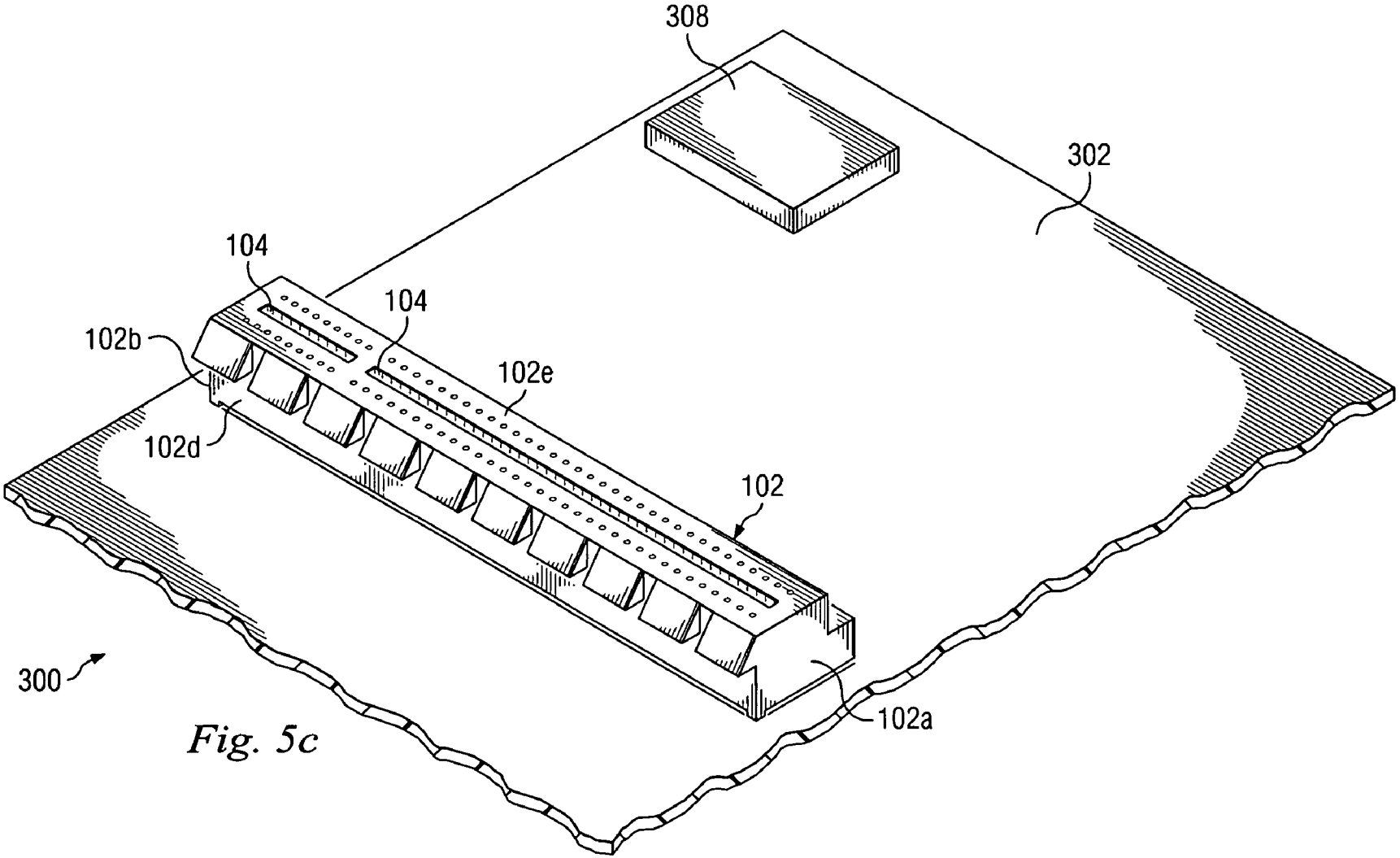
FIG. 5*c* is a perspective view illustrating an embodiment of the large card connector of FIG. 2*a* mounted to the board of FIG. 4 using the method of FIG. 5*a*.
Figure 5D:
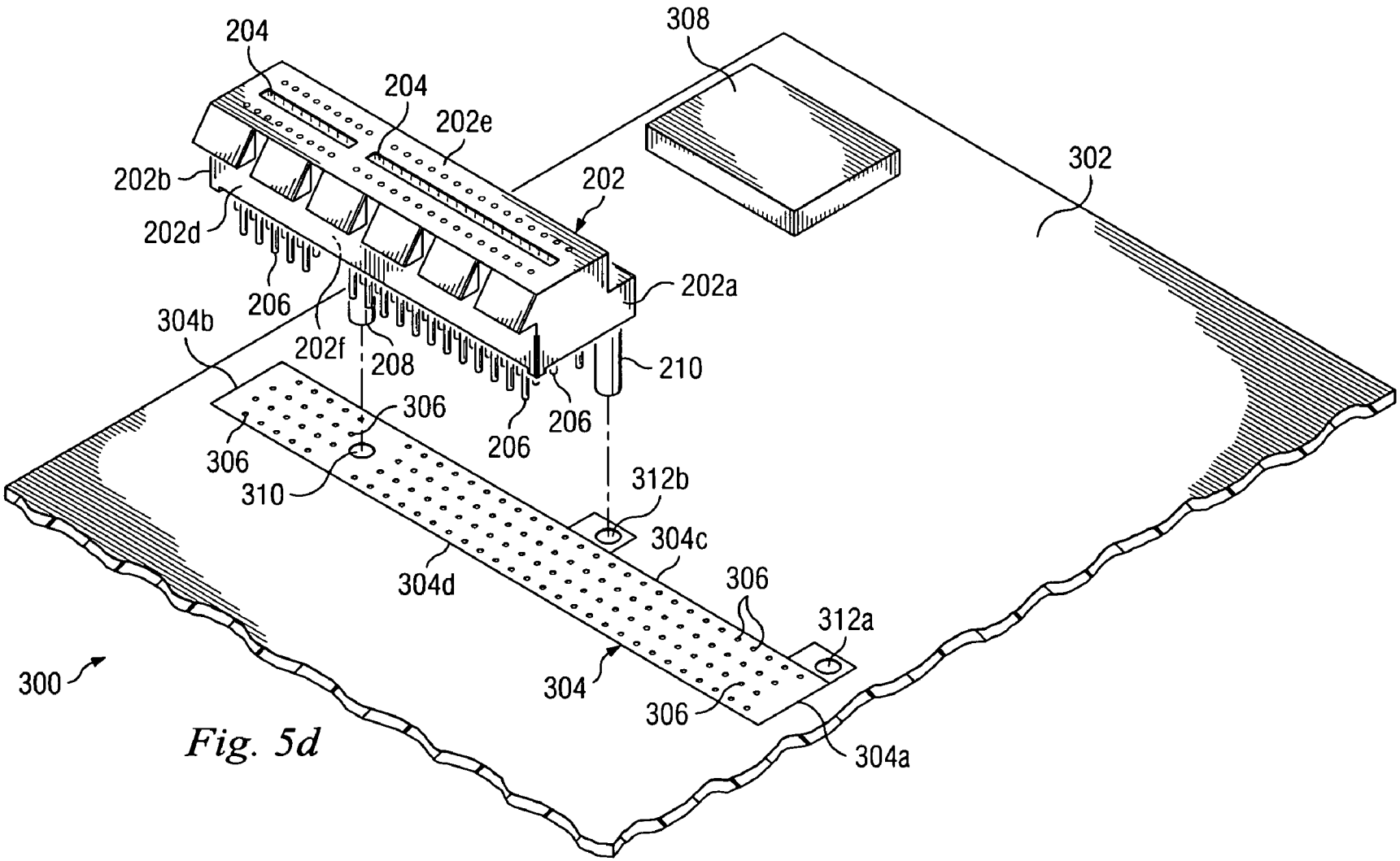
FIG. 5*d* is a perspective view illustrating an embodiment of the small card connector of FIG. 3*a* being mounted to the board of FIG. 4 during the method of FIG. 5*a*.
Figure 5E:
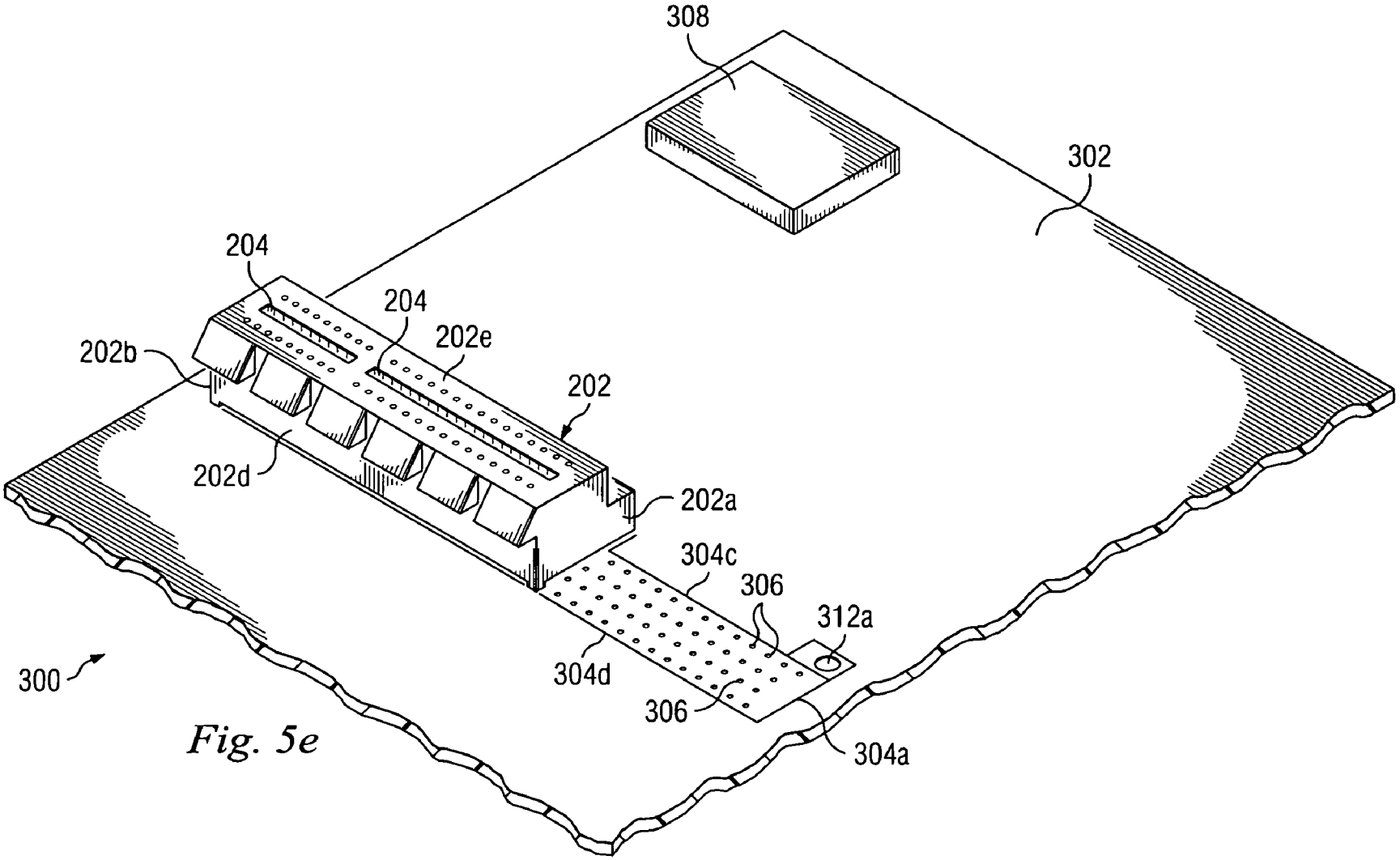
FIG. 5*e* is a perspective view illustrating an embodiment of the small card connector of FIG. 3*a* mounted to the board of FIG. 4 using the method of FIG. 5*a*.

Referring now to FIG. 5*a*, a method for mounting a card connector 400 is illustrated. Method begins at step 402 where the board 300, illustrated in FIG. 4, is provided. Board 300 may be mounted in a chassis such as, for example, the chassis 26 illustrated in FIG. 1, and may include components of an information handling system such as, for example, the information handling system 10 illustrated in FIG. 1. The method 400 then proceeds to step 404 where the card connector 100 and the card connector 200, illustrated in FIGS. 2*a* and 3*a*, are provided. Card connector 100 and card connector 200 are different size card connectors and, in an embodiment, may include a ×16 PCI-Express connector and a ×8 PCI-Express connector, respectively.

Referring now to FIGS. 2*b*, 5*a*, 5*b*, and 5*c*, the method 400 proceeds to step 406 where a desired card connector size is determined. The determination of the desired card connector size will depend on the bandwidth needed for the card to be coupled to the board 300. In an embodiment, a relatively larger bandwidth will be needed for the card, and the card connector 100 will be determined to be the appropriate sized card connector. The method 400 then proceeds to step 408 where card connector 100 is mounted and electrically coupled to the board 300. The card connector 100 is positioned over the connector coupling section 304 on the board surface 302 such that first base end 102*a* is lined up with first section end 304*a*, second base end 102*b* is lined up with second section end 304*b*, first base side 102*c* is lined up with first section side 304*c*, second base side 102*d* is lined up with second section side 304*d*, board mounting member 108 is lined up with connector coupling member 310, and board mounting member 110 is lined up with connector coupling member 312*a*. The card connector 100 may then be lowered onto the base 300 such that board mounting member 108 engages connector coupling member 310 and board mounting member 110 engages connector coupling member 312*a*, resulting in the mounting of the card connector 100 to the board 300. The electrical coupling members 106 may then be electrically coupled to the electrical connector couplers 306 using methods known in the art such as, for example, soldering, resulting in the electrical coupling of the card connector 100 to the board 300. In an embodiment, the electrical coupling of the card connector 100 to the board 300 electrically couples the card connector 100 to the information handling system component 308.

However, referring now to FIGS. 3*b*, 5*a*, 5*d*, and 5*e*, in an embodiment, a relatively smaller bandwidth will be needed for the card, and the card connector 200 will be determined to be the appropriate sized card connector. The method 400 then proceeds to step 408 where card connector 200 is mounted and electrically coupled to the board 300. The card connector 200 is positioned over the connector coupling section 304 on the board surface 302 such that second base end 202*b* is lined up with second section end 304*b*, first base side 202*c* is lined up with first section side 304*c*, second base side 202*d* is lined up with second section side 304*d*, board mounting member 208 is lined up with connector coupling member 310, and board mounting member 210 is lined up with connector coupling member 312*b*. The card connector 200 may then be lowered onto the base 300 such that board mounting member 208 engages connector coupling member 310 and board mounting member 210 engages connector coupling member 312*b*, resulting in the mounting of the card connector 200 to the board 300. The electrical coupling members 206 may then be electrically coupled to the electrical connector couplers 306 using methods known in the art such as, for example, soldering, resulting in the electrical coupling of the card connector 200 to the board 300. In an embodiment, the electrical coupling of the card connector 200 to the board 300 electrically couples the card connector 200 to the information handling system component 308. In an embodiment, the card connector 100, card connector 200, and board 300 provide a card connector mounting system. Thus, a card connector mounting system is provided which allows a plurality of different sized card connectors such as, for example, the card connectors 100 and 200, to be connected to the same connector coupling section such as, for example, the connector coupling section 304. In an embodiment, the plurality of different sized card connectors may include ×1 PCI-Express connectors, ×2 PCI-Express connectors, ×4 PCI-Express connectors, ×8 PCI-Express connectors, ×12 PCI-Express connectors, ×16 PCI-Express connectors, ×32 PCI-Express connectors, ×64 PCI-Express connectors, and a variety of other card connectors known in the art.

Figure 6A:
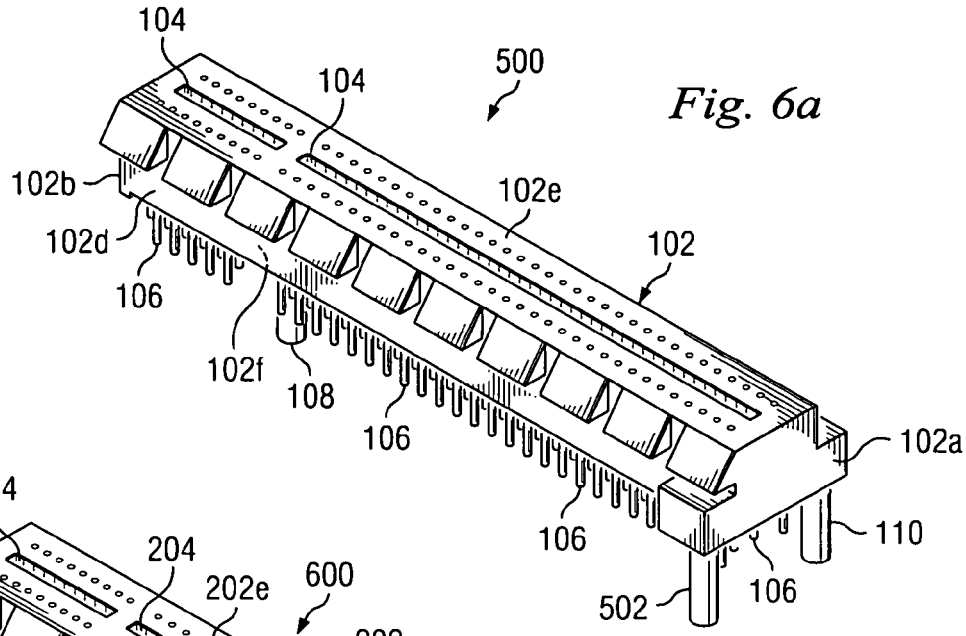
FIG. 6*a* is a perspective view illustrating an embodiment of a large card connector.
Figure 6B:
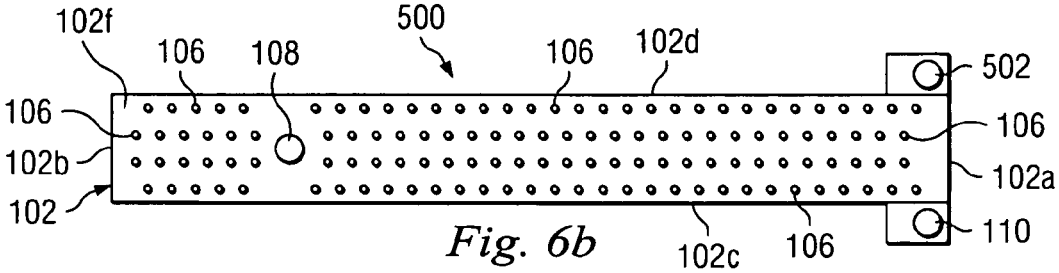
FIG. 6*b* is a bottom view illustrating an embodiment of the large card connector of FIG. 6*a*.

Referring now to FIGS. 6*a* and 6*b*, in an alternative embodiment, a large card connector 500 is substantially similar to the large card connector 100, described above with reference to FIGS. 2*a* and 2*b*, with the provision of a board mounting member 502 extending from the second base side 102*d* away from the base 102 and then down past the bottom base surface 102*f*, and positioned opposite the board mounting member 110 and adjacent the bottom base surface 102*f* and the first base end 102*a*. In an exemplary embodiment, the card connector 500 includes a ×64 PCI-Express connector. In an exemplary embodiment, the card connector 500 includes a ×32 PCI-Express connector. In an exemplary embodiment, the card connector 500 includes a ×16 PCI-Express connector. In an exemplary embodiment, the card connector 500 includes a ×8 PCI-Express connector. In an exemplary embodiment, the card connector 500 includes a ×4 PCI-Express connector. In an exemplary embodiment, the card connector 500 includes a ×1 PCI-Express connector.

Figure 7A:
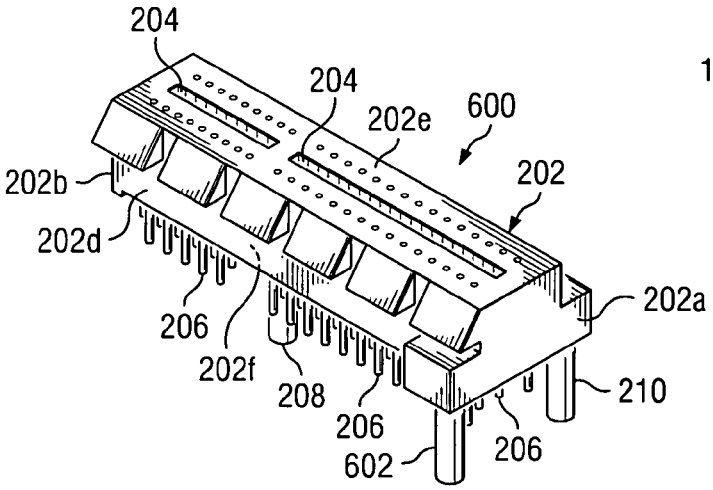
FIG. 7*a* is a perspective view illustrating an embodiment of a small card connector.
Figure 7B:
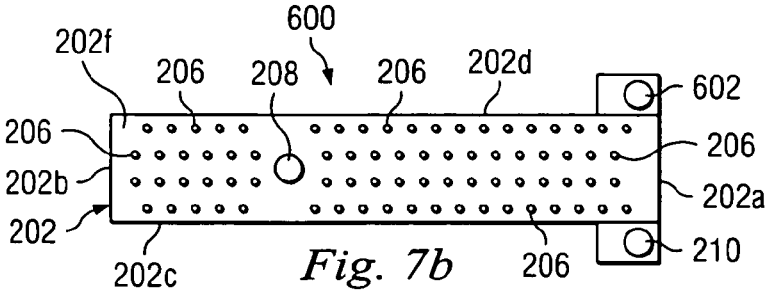
FIG. 7*b* is a bottom view illustrating an embodiment of the small card connector of FIG. 3*a*.

Referring now to FIGS. 7*a* and 7*b*, in an alternative embodiment, a small card connector 600 is substantially similar in design and operation to the small card connector 200, described above with reference to FIGS. 3*a* and 3*b*, with the provision of a board mounting member 602 extending from the second base side 202*c* away from the base 202 and then down past the bottom base surface 202*f*, and positioned opposite the board mounting member 210 and adjacent the bottom base surface 202*f* and the first base end 202*a*. In an exemplary embodiment, the card connector 600 includes a ×64 PCI-Express connector. In an exemplary embodiment, the card connector 600 includes a ×32 PCI-Express connector. In an exemplary embodiment, the card connector 600 includes a ×16 PCI-Express connector. In an exemplary embodiment, the card connector 600 includes a ×8 PCI-Express connector. In an exemplary embodiment, the card connector 600 includes a ×4 PCI-Express connector. In an exemplary embodiment, the card connector 600 includes a ×1 PCI-Express connector.

Figure 8:
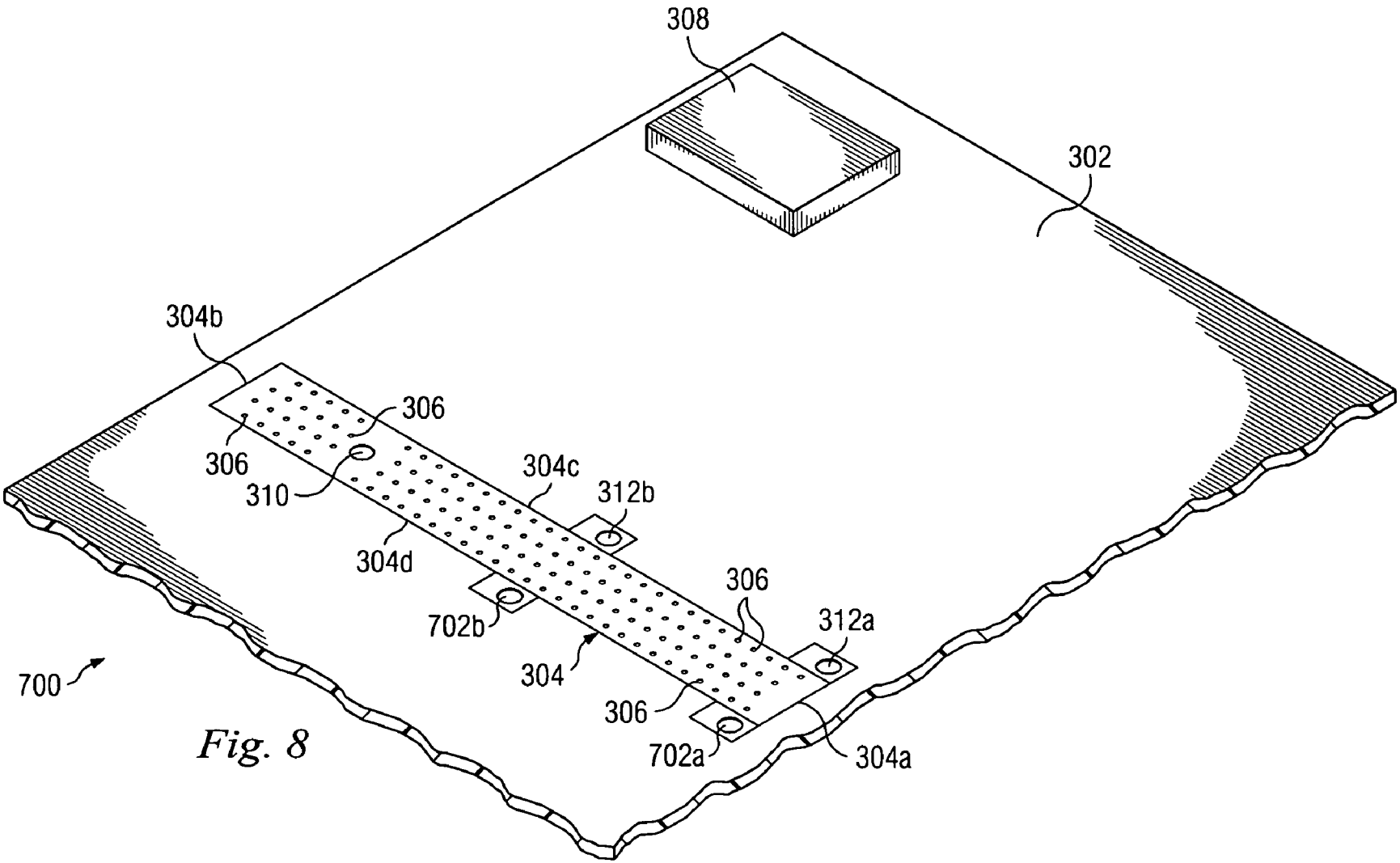
FIG. 8 is a perspective view illustrating an embodiment of a board used with the large card connector of FIG. 6*a* and the small card connector of FIG. 7*a*.

Referring now to FIG. 8, in an alternative embodiment, a board 700 is substantially similar in design and operation to the board 300, described above with reference to FIG. 4, with the provision of a plurality of connector coupling members 702*a* and 702*b* defined by the board 700, located on the board surface 302 and outside the connector coupling section 304, and positioned in a spaced apart relationship adjacent the second section side 304*d* and opposite the connector coupling members 312*a* and 312*b*, respectively. In an embodiment, connector coupling member 702*a* is positioned adjacent the first section end 304*a* and connector coupling member 702*b* is positioned substantially midway between the first section end 304*a* and the second section end 304*b*. In an embodiment, the board 700 may be mounted in the chassis 26, described above with reference to FIG. 1, and may include one of more of the components of information handling system 10.

Figures 9A, 9B:
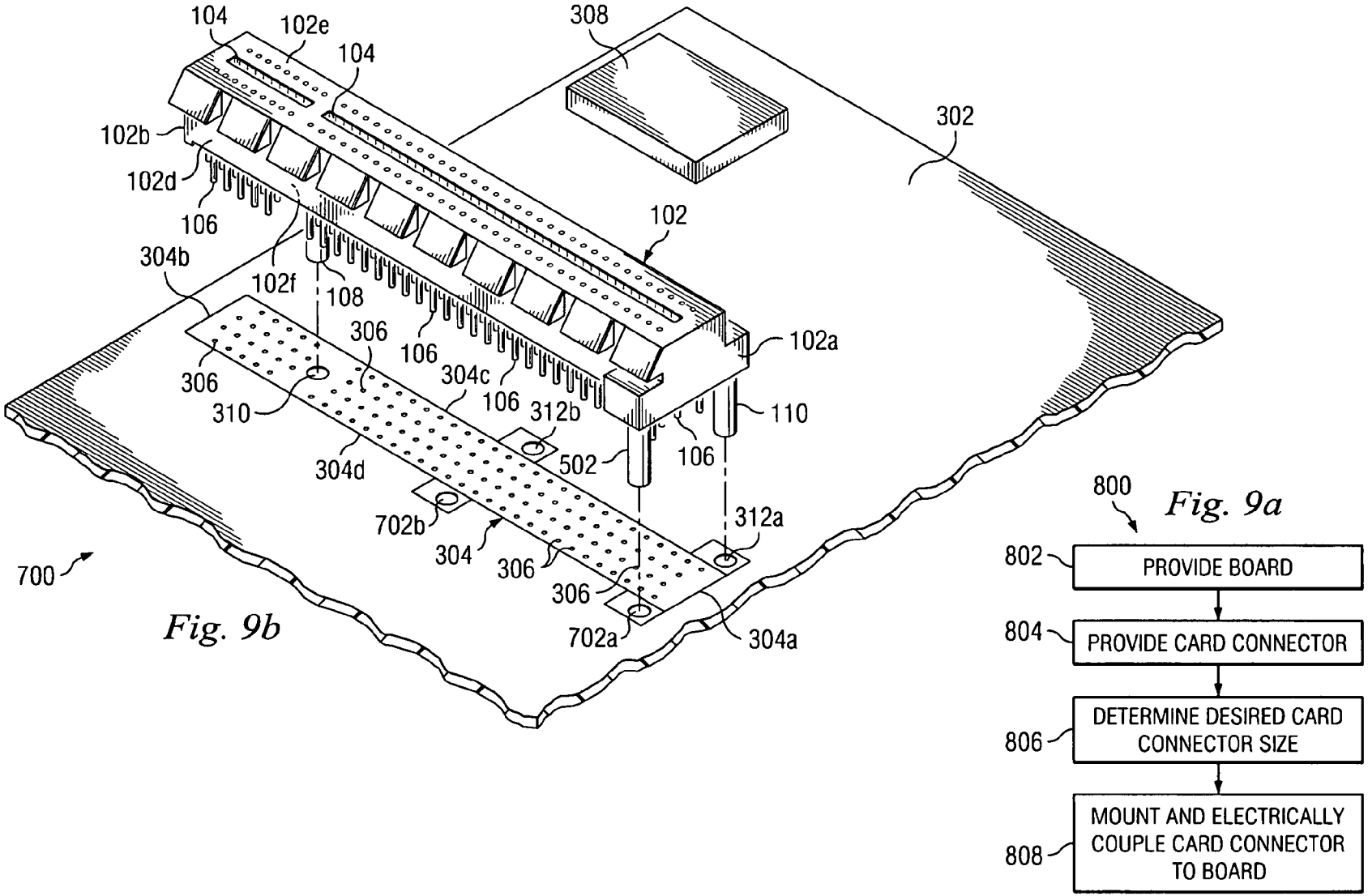
FIG. 9*a* is a flow chart illustrating an embodiment of a method for mounting a card connector using the large card connector of FIG. 6*a*, the small card connector for FIG. 7*a*, and the board of FIG. 8.
FIG. 9*b* is a perspective view illustrating an embodiment of the large card connector of FIG. 6*a* being mounted to the board of FIG. 8 during the method of FIG. 9*a*.
Figure 9C:
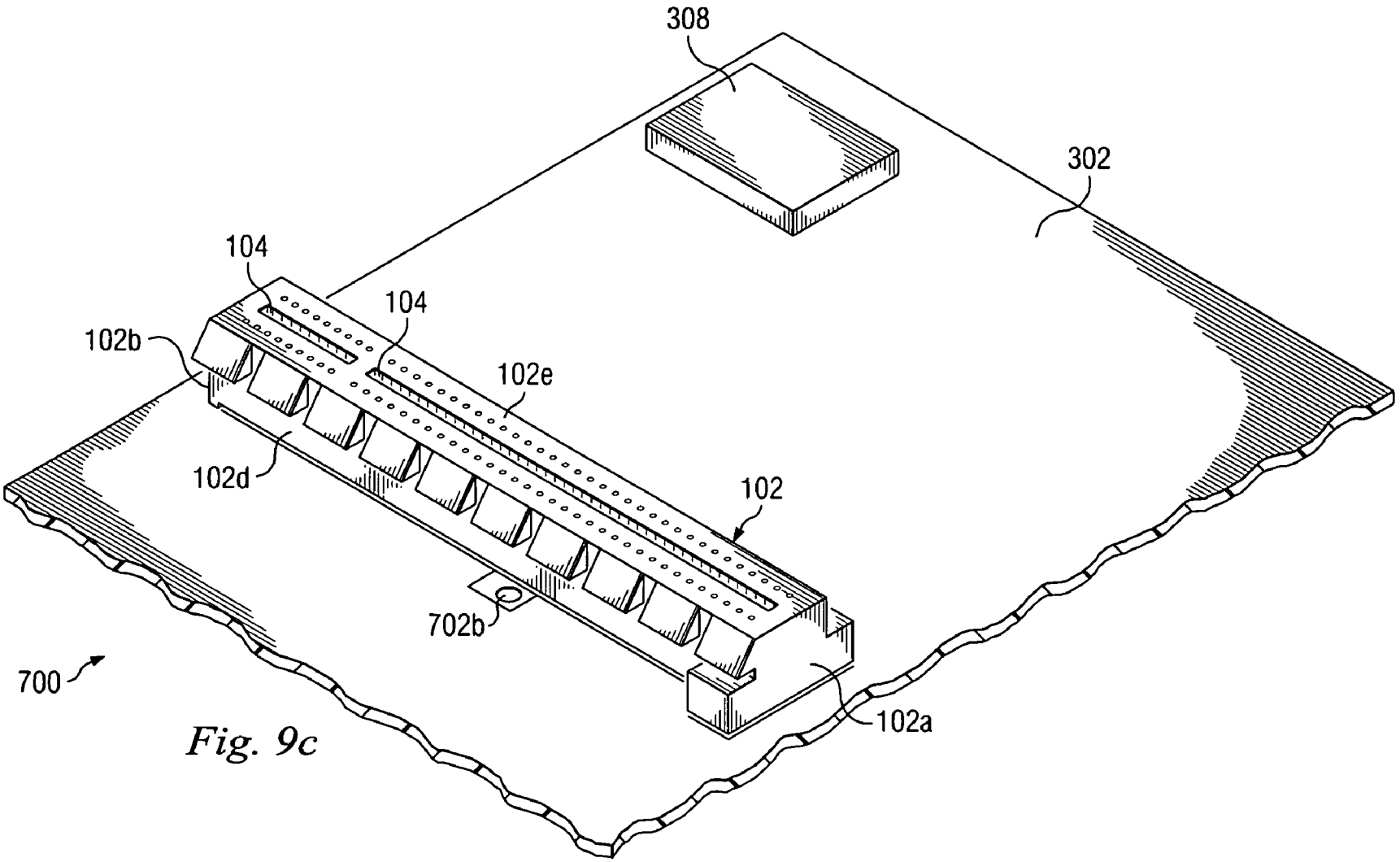
FIG. 9*c* is a perspective view illustrating an embodiment of the large card connector of FIG. 6*a* mounted to the board of FIG. 8 using the method of FIG. 9*a*.
Figure 9D:
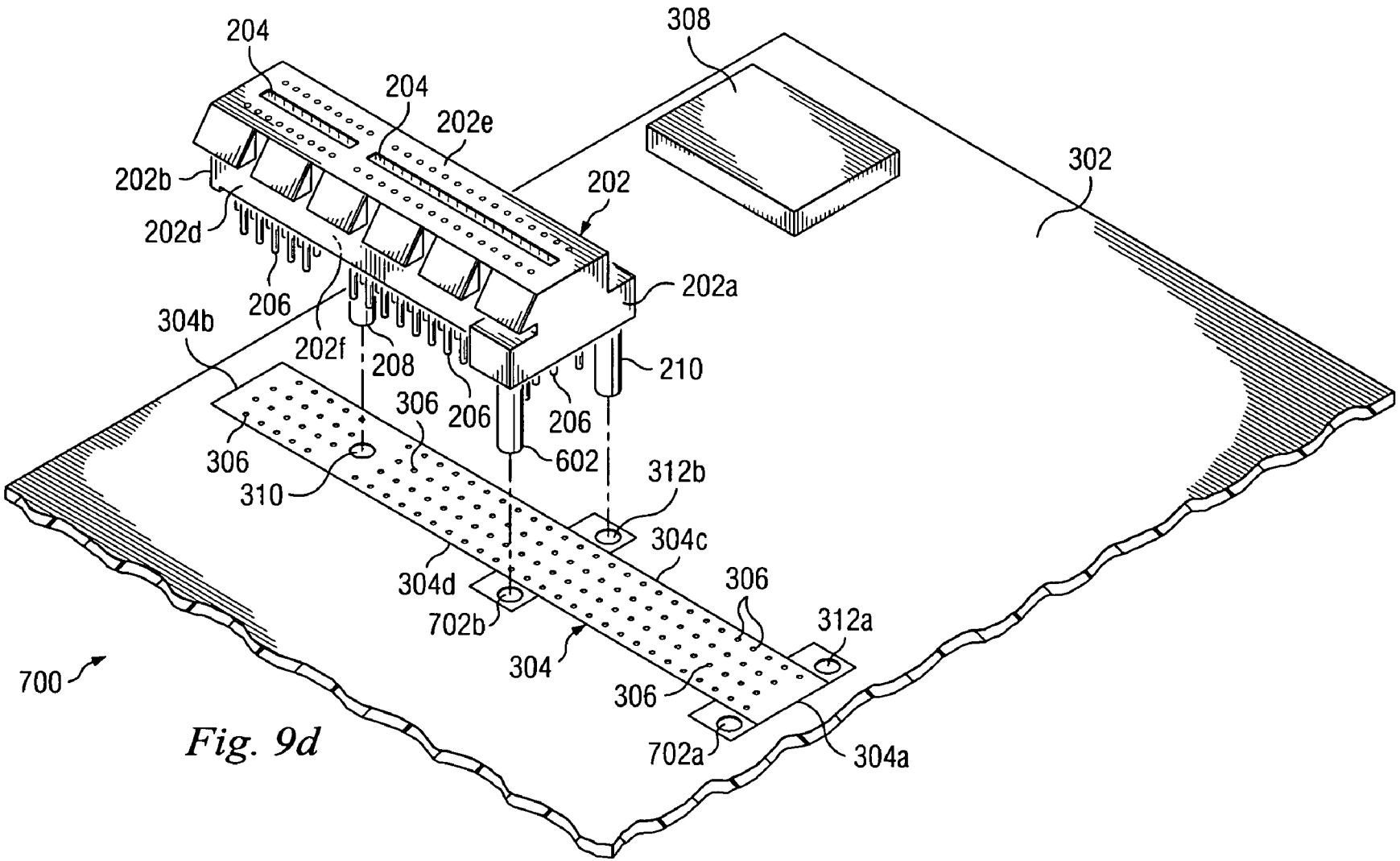
FIG. 9*d* is a perspective view illustrating an embodiment of the small card connector of FIG. 7*a* being mounted to the board of FIG. 8 during the method of FIG. 9*a*.
Figure 9E:
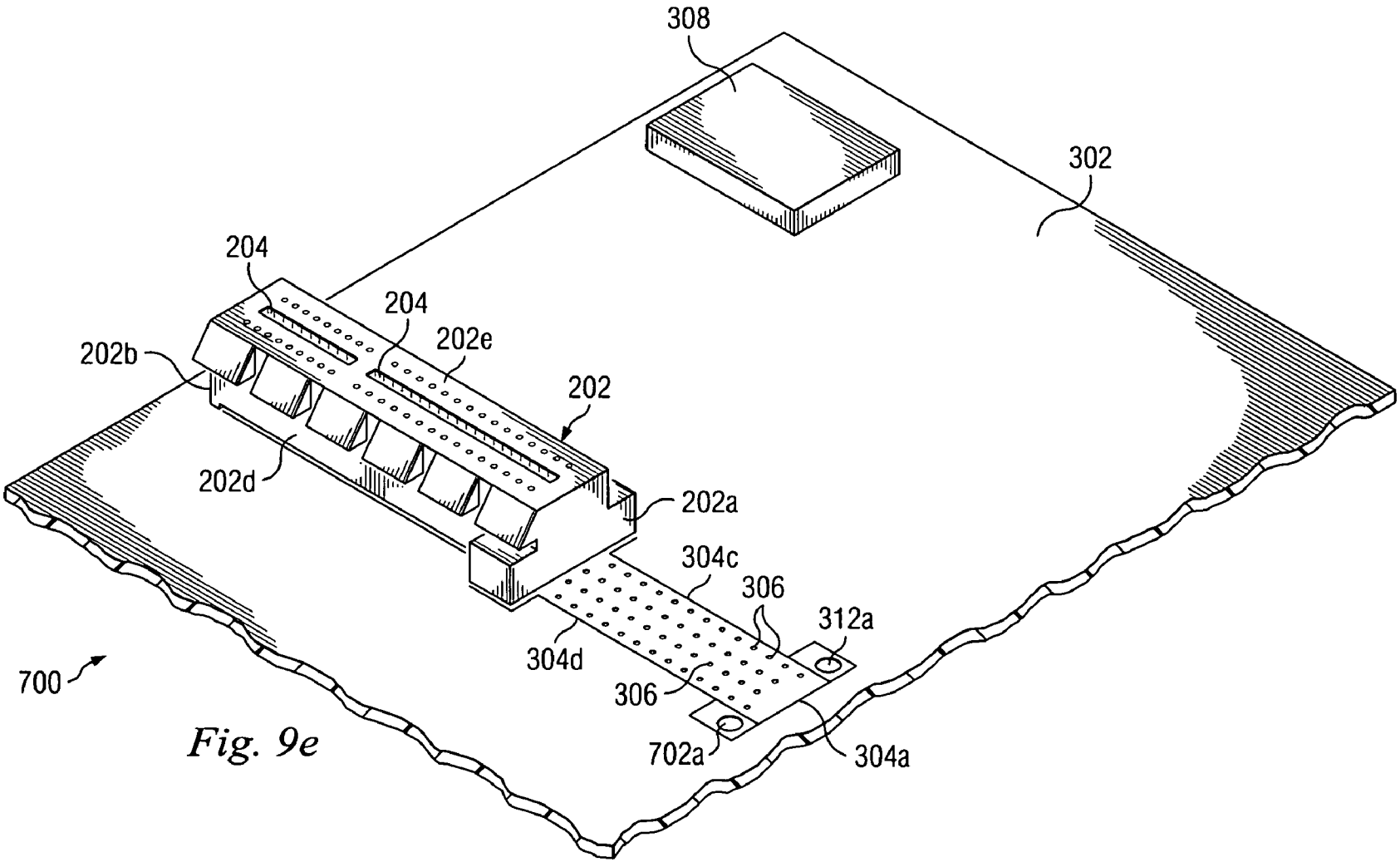
FIG. 9*e* is a perspective view illustrating an embodiment of the small card connector of FIG. 7*a* mounted to the board of FIG. 8 using the method of FIG. 9*a*.

Referring now to FIG. 9*a*, a method for mounting a card connector 800 is illustrated. Method 800 begins at step 802 where the board 700, illustrated in FIG. 8, is provided. Board 700 may be mounted in a chassis such as, for example, the chassis 26 illustrated in FIG. 1, and may include components of an information handling system such as, for example, the information handling system 10 illustrated in FIG. 1. The method 800 then proceeds to step 804 where the card connector 500 and the card connector 600, illustrated in FIGS. 6*a* and 7*a*, are provided. Card connector 500 and card connector 600 are different size card connectors and, in an embodiment, may include a ×16 PCI-Express connector and a ×8 PCI-Express connector, respectively.

Referring now to FIGS. 6*b*, 9*a*, 9*b*, and 9*c*, the method 800 proceeds to step 806 where a desired card connector size is determined. The determination of the desired card connector size will depend on the bandwidth needed for the card to be coupled to the board 700. In an embodiment, a relatively larger bandwidth will be needed for the card, and the card connector 500 will be determined to be the appropriate sized card connector. The method 700 then proceeds to step 808 where card connector 500 is mounted and electrically coupled to the board 700. The card connector 500 is positioned over the connector coupling section 304 on the board surface 302 such that first base end 102*a* is lined up with first section end 304*a*, second base end 102*b* is lined up with second section end 304*b*, first base side 102*c* is lined up with first section side 304*c*, second base side 102*d* is lined up with second section side 304*d*, board mounting member 108 is lined up with connector coupling member 310, board mounting member 110 is lined up with connector coupling member 312*a*, and board mounting member 502 is lined up with connector coupling member 702*a*. The card connector 500 may then be lowered onto the base 700 such that board mounting member 108 engages connector coupling member 310, board mounting member 110 engages connector coupling member 312*a*, and board mounting member 502 engages connector coupling member 702*a*, resulting in the mounting of the card connector 500 to the board 700. The electrical coupling members 106 may then be electrically coupled to the electrical connector couplers 306 using methods known in the art such as, for example, soldering, resulting in the electrical coupling of the card connector 500 to the board 700. In an embodiment, the electrical coupling of the card connector 500 to the board 700 electrically couples the card connector 500 to the information handling system component 308.

However, referring now to FIGS. 7*b*, 9*a*, 9*d*, and 9*e*, in an embodiment, a relatively smaller bandwidth will be needed for the card, and the card connector 600 will be determined to be the appropriate sized card connector. The method 800 then proceeds to step 808 where card connector 600 is mounted and electrically coupled to the board 700. The card connector 600 is positioned over the connector coupling section 304 on the board surface 302 such that second base end 202*b* is lined up with second section end 304*b*, first base side 202*c* is lined up with first section side 304*c*, second base side 202*d* is lined up with second section side 304*d*, board mounting member 208 is lined up with connector coupling member 310, board mounting member 210 is lined up with connector coupling member 312*b*, and board mounting member 602 is lined up with connector coupling member 702*b*. The card connector 600 may then be lowered onto the base 700 such that board mounting member 208 engages connector coupling member 310, board mounting member 210 engages connector coupling member 312*b*, and board mounting member 602 engages connector coupling member 702*b*, resulting in the mounting of the card connector 600 to the board 700. The electrical coupling members 206 may then be electrically coupled to the electrical connector couplers 306 using methods known in the art such as, for example, soldering, resulting in the electrical coupling of the card connector 600 to the board 700. In an embodiment, the electrical coupling of the card connector 600 to the board 700 electrically couples the card connector 600 to the information handling system component 308. In an embodiment, the card connector 500, card connector 600, and board 700 provide a card connector mounting system. Thus, a card connector mounting system is provided which allows a plurality of different sized card connectors such as, for example, the card connectors 500 and 600, to be connected to the same connector coupling section such as, for example, the connector coupling section 304. In an embodiment, the plurality of different sized card connectors may include ×1 PCI-Express connectors, ×2 PCI-Express connectors, ×4 PCI-Express connectors, ×8 PCI-Express connectors, ×12 PCI-Express connectors, ×16 PCI-Express connectors, ×32 PCI-Express connectors, ×64 PCI-Express connectors, and a variety of other card connectors known in the art.

Figure 10:
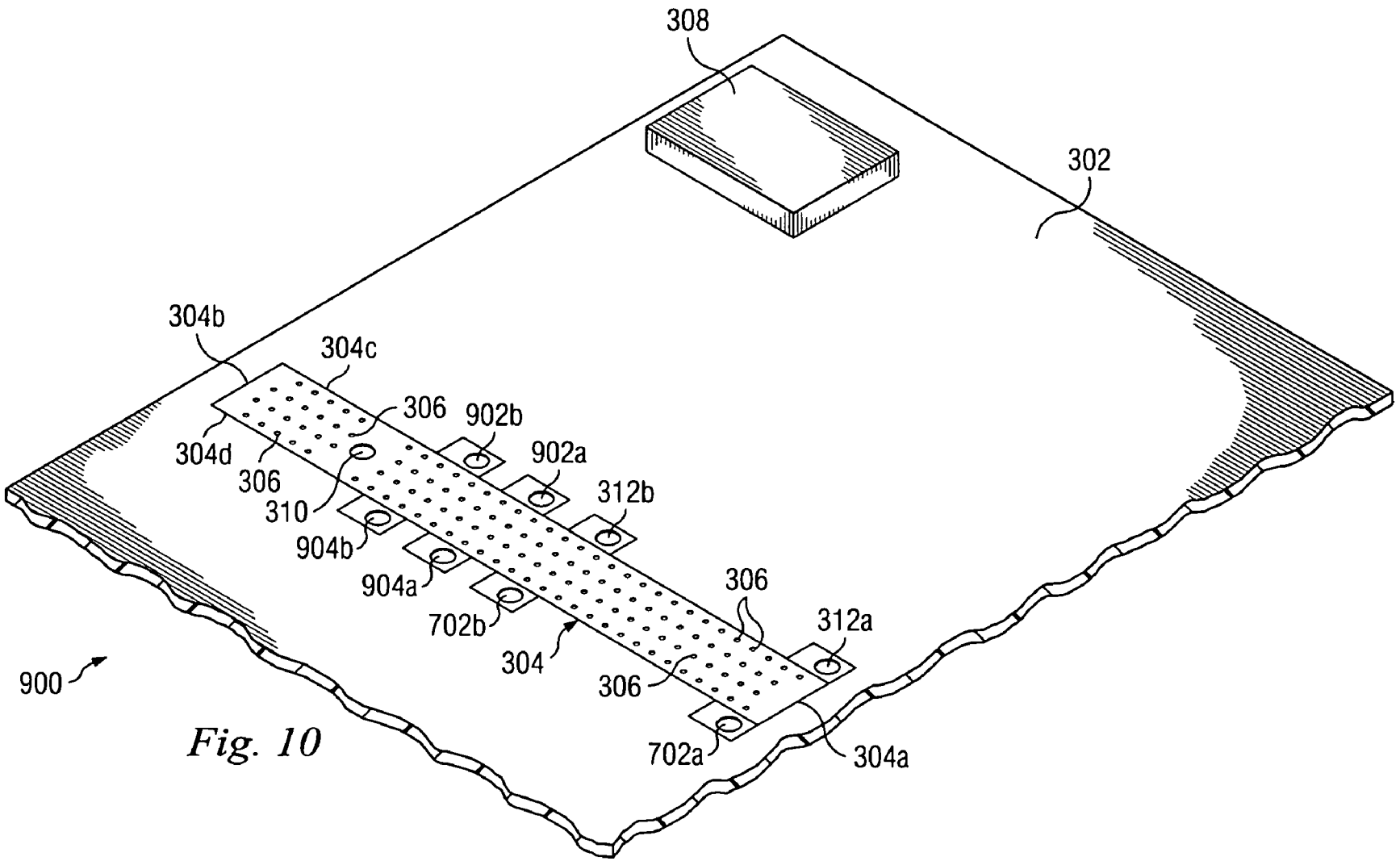
FIG. 10 is a perspective view illustrating an alternative embodiment of a board.

Referring now to FIG. 10, in an alternative embodiment, a board 900 is substantially similar in design and operation to the board 700, described above with reference to FIG. 8, with the provision of a plurality of connector coupling members 902*a* and 902*b* defined by the board 900, located on the board surface 302 and outside the connector coupling section 304, and positioned in a spaced apart relationship adjacent the first section side 304*c* and between the connector coupling member 312*b* and the second section end 304*b*. A plurality of connector coupling members 904*a* and 904*b* are also defined by the board 900, located on the board surface 302 and outside the connector coupling section 304, and positioned in a spaced apart relationship adjacent the second section side 304*d*, between the connector coupling member 702*b* and the second section end 304*b*, and opposite the connector coupling members 902*a* and 902*b*, respectively. In operation, the board mounting members 310, 312*a* and 702*a*, 312*b* and 702*b*, 902*a* and 904*a*, and 902*b* and 904*b* may be used to mount a plurality of different sized card connectors to the connector coupling section 604 on the board 900 in substantially the same manner as described above in methods 400 and 800. In an embodiment, additional connector coupling members may be added to the board to allow additional sizes of card connectors to be coupled to the connector coupling section 604 on the board 900.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A card connector mounting apparatus comprising:

a first card connector of a first size;

a second card connector of a second size different from the first size;

each card connector including a plurality of electrical coupling members and a pair of board mounting members; and a board having a plurality of electrical receivers for receiving the electrical coupling members and a plurality of mounting receivers for receiving the board mounting members, the mounting receivers including a common mounting receiver positioned to receive one of the board mounting members of each of the first and second connectors, a first mounting receiver positioned to receive a board mounting member of only the first card connector and a second mounting receiver positioned to receive a board mounting member of only the second card connector.

2. The apparatus of claim 1:

wherein the common mounting receiver and the first mounting receiver are spaced apart to simultaneously receive the pair of board mounting members of the first card connector.

3. The apparatus of claim 1:

wherein the common mounting receiver and the second mounting receiver are spaced apart to simultaneously receive the pair of board mounting members of the second card connector.

4. The apparatus of claim 1:

wherein the common mounting receiver is positioned between some of the electrical receivers.

5. The apparatus of claim 1 wherein the first and second mounting receivers are positioned laterally adjacent others of the electrical receivers.

6. A multiple card connector mounting system comprising:

a board having a single connection location for receiving a pair of variable size connectors;

the pair including a first card connector of a first size and a second card connector of a second size different from the first size, each card connector including a plurality of electrical coupling members and a pair of board mounting members; and the board including a plurality of electrical receivers for receiving the electrical coupling members and a plurality of mounting receivers for receiving the board mounting members, the mounting receivers including a common mounting receiver positioned to receive one of the board mounting members of each of the first and second connectors, a first mounting receiver positioned to receive a board mounting member of only the first card connector and a second mounting receiver positioned to receive a board mounting member of only the second card connector.

7. A method for mounting multiple card connectors comprising:

providing a first card connector of a first size;

providing a second card connector of a second size different from the first size;

including in each card connector, a plurality of electrical coupling members and a pair of board mounting members; and providing a board having a plurality of electrical receivers for receiving the electrical coupling members and a plurality of mounting receivers for receiving the board mounting members, the mounting receivers including a common mounting receiver positioned to receive one of the board mounting members of each of the first and second connectors, a first mounting receiver positioned to receive a board mounting member of only the first card connector and a second mounting receiver positioned to receive a board mounting member of only the second card connector.

* * * * *